US006314589B1

(12) United States Patent
Schilt

(10) Patent No.: US 6,314,589 B1
(45) Date of Patent: Nov. 13, 2001

(54) TOILET LID SAFETY LOCK

(75) Inventor: Piet Schilt, Schoonhoven (NL)

(73) Assignee: Kidco, Inc., Mundelein, IL (US)

( * ) Notice: Subject to any disclaimer, the term of this patent is extended or adjusted under 35 U.S.C. 154(b) by 0 days.

(21) Appl. No.: 09/693,529

(22) Filed: Oct. 20, 2000

(51) Int. Cl.[7] ..... A47K 13/24
(52) U.S. Cl. ..... 4/253; 70/159
(58) Field of Search ..... 4/253, 661; 70/159; 292/194, 224

(56) References Cited

U.S. PATENT DOCUMENTS

| | | | | |
|---|---|---|---|---|
| 2,651,053 | * | 9/1953 | Rowe et al. | 4/253 |
| 2,698,439 | * | 1/1955 | Bruckner | 4/253 |
| 3,056,972 | * | 10/1962 | Miller | 4/253 |
| 4,395,784 | | 8/1983 | Foster . | |
| 4,404,695 | | 9/1983 | Camp . | |
| 4,479,273 | | 10/1984 | Raden et al. . | |
| 4,502,167 | * | 3/1985 | Porzelius | 4/253 |
| 4,724,551 | | 2/1988 | Gardner . | |
| 4,763,363 | | 8/1988 | Lallemand . | |
| 4,833,737 | | 5/1989 | Boucher et al. . | |
| 4,894,870 | * | 1/1990 | Buckshaw et al. | 4/253 |
| 5,003,641 | * | 4/1991 | Selman, Jr. | 4/253 |
| 5,347,663 | | 9/1994 | Yost . | |
| 5,682,776 | | 11/1997 | Burt . | |

* cited by examiner

*Primary Examiner*—Charles R. Eloshway
(74) *Attorney, Agent, or Firm*—Piper Marbury Rudnick & Wolfe

(57) ABSTRACT

A toilet lid lock for maintaining a toilet lid in a closed position. The toilet lid lock is comprised of an upper portion including a horizontally extending arm and a vertically extending stem and a base including a flange portion with slots and a sleeve. The stem of the upper portion is inserted into the sleeve of the base. The height of the arm is adjusted by a set screw positioned in the sleeve. The arm is positioned across a toilet lid and prevents the toilet lid from being lifted. The arm is unlocked when a user presses a release button and rotates the arm so that it is parallel to the tank ofthe toilet. The toilet lid is then free to be lifted to an upright position. Once the toilet lid is lowered, the toilet lid lock automatically resets by rotating the arm back to its original position.

8 Claims, 4 Drawing Sheets

TOILET LID SAFETY LOCK

BACKGROUND OF THE INVENTION

1. Field of the Invention

The present invention relates generally to toilet lid locks and, more particularly, to an improved toilet lid lock that automatically locks once the toilet lid is lowered.

2. Description of the Related Art

Everyone desires to provide a safe and secure household for their children. However, a home presents various dangerous environments for curious unsupervised children. One such situation involves the toilet and the toilet lid.

An open toilet seat is an invitation for an accident that could be hazardous to young children. There is a risk that small children could potentially fall into the bowl and drown. There is also a risk that small children could injure themselves by either lifting the lid and seat or by the lid and seat falling on the child. Additionally, there is a concern with the unsanitary water in the bowl. Often times children throw their toys into the toilet and then want to play with their toys.

The prior art has not yet provided an optimal solution for an economical, safe, easy to use and easy to install toilet lock. For example, U.S. Pat. Nos. 4,833,737 to Boucher et al. and U.S. Pat. No. 5,682,776 to Burt each disclose a multiple piece toilet lock that is mounted to the exterior of the toilet bowl by an adhesive. The disadvantage using an adhesive is that the adhesive wears out with time and weakens as a result of the temperature and humidity in the bathroom. The toilet locks disclosed in these patents are also difficult to install because of the requirement for exact placement when attaching the lock pieces with the adhesive. Further, the toilet lock taught by the Burt '776 patent requires one piece to be bolted to the toilet lid. This permanent modification to the lid is undesirable because it precludes using a toilet seat cover and could injure an individual sitting on the toilet.

U.S. Pat. Nos. 4,724,551 to Gardner, U.S. Pat. No. 4,404,695 to Camp, U.S. Pat. No. 4,479,273 to Raden et al. and U.S. Pat. No. 5 4,395,784 to Foster teach toilet locks that include small lock actuating components thereby making the toilet locks difficult to use. Furthermore, once the devices of the Gardner '551 and Camp '695 patents are placed in an unlocked position, each of the disclosed toilet locks remains unlocked until the user locks the toilet lock. Failure to manually reset the toilet lock defeats its purpose.

U.S. Pat. No. 5,347,663 to Yost teaches a toilet lock that is not capable of being adjusted to accommodate various toilet lid thicknesses or covers. In addition, as with the devices of the Gardner '551 patent and the Foster '784 patent, a user must reach down to the proximity of the toilet seat hinge to release the lock. Such method of operation is inconvenient and potentially unsanitary.

Accordingly, it is an object of the present invention to provide a toilet lid lock that is adjustable to fit a variety of toilet and toilet lid sizes.

It is an another object of the present invention to provide a toilet lid lock that keeps children and their toys out of the toilet bowl.

It is another object of the present invention to provide a toilet lid lock which is fastened to the toilet and maintains the toilet lid in a generally closed configuration until the lock is released.

It is another object of the present invention to provide a toilet lid lock that is easy for adults to use.

It is still another object of the present invention to provide a toilet lid lock that automatically resets when the toilet lid is lowered to its horizontal position.

It is still another object of the present invention to provide a toilet lid lock which is economical to manufacture and easy to install.

SUMMARY OF THE INVENTION

The present invention is directed to a toilet lid lock that is fastened to the toilet and maintains the toilet lid in a closed position until the lock is released. The toilet lid lock features a base and an upper portion. The base includes a sleeve with a set screw and a flange portion with slots for mounting the device to the bolts of the existing toilet lid hinge. The upper portion includes a housing with an arm, a release button and a stem secured to the housing. The stem is inserted into the sleeve of the base. The height of the arm is adjusted by positioning the stem in the sleeve to the desired height and then securing the stem with the set screw. When the toilet lid lock is in the locked configuration, the arm is positioned above the toilet lid so as to prevent the lid from being raised. The toilet lid lock is unlocked when the user presses the release button and rotates the arm away from the front of the toilet. The toilet lid is then free to be raised to an upright position. Once the toilet lid is lowered, the arm, due to bias of a spring, automatically swings back over the toilet lid so that the toilet lid lock is automatically reset.

The following detailed description of embodiments of the invention, taken in conjunction with the appended claims and accompanying drawings, provide a more complete understanding of the nature and scope of the invention.

DETAILED DESCRIPTION OF THE INVENTION

Figure 2:
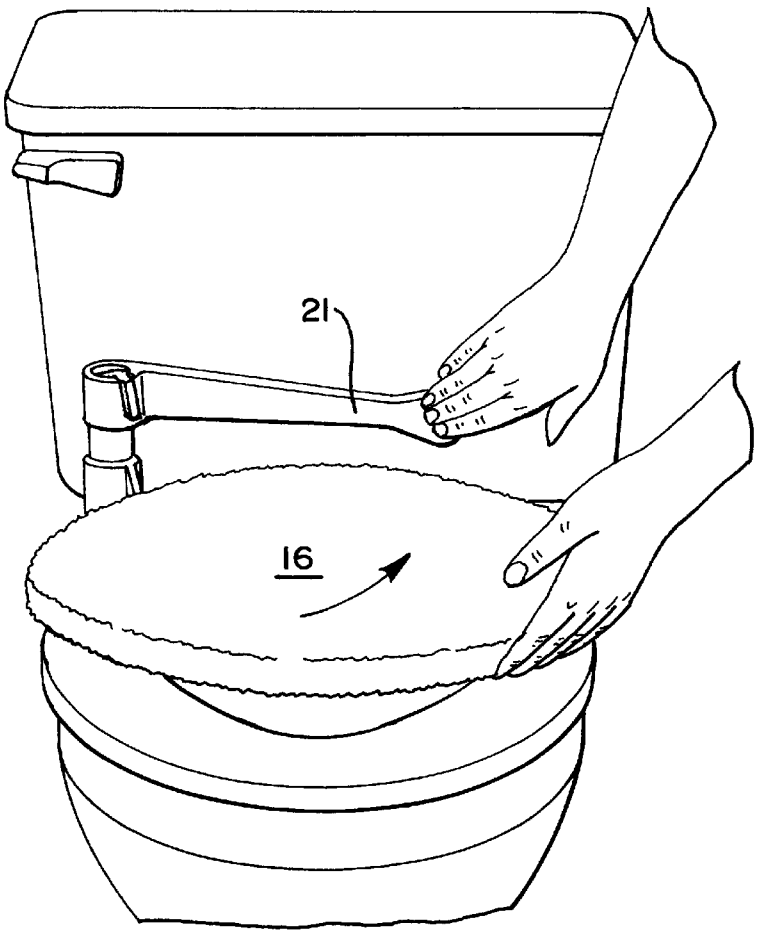
FIG. 2 is a perspective view of the toilet lid lock and toilet of FIG. 1 with the arm in the unlocked position.
Figure 1:
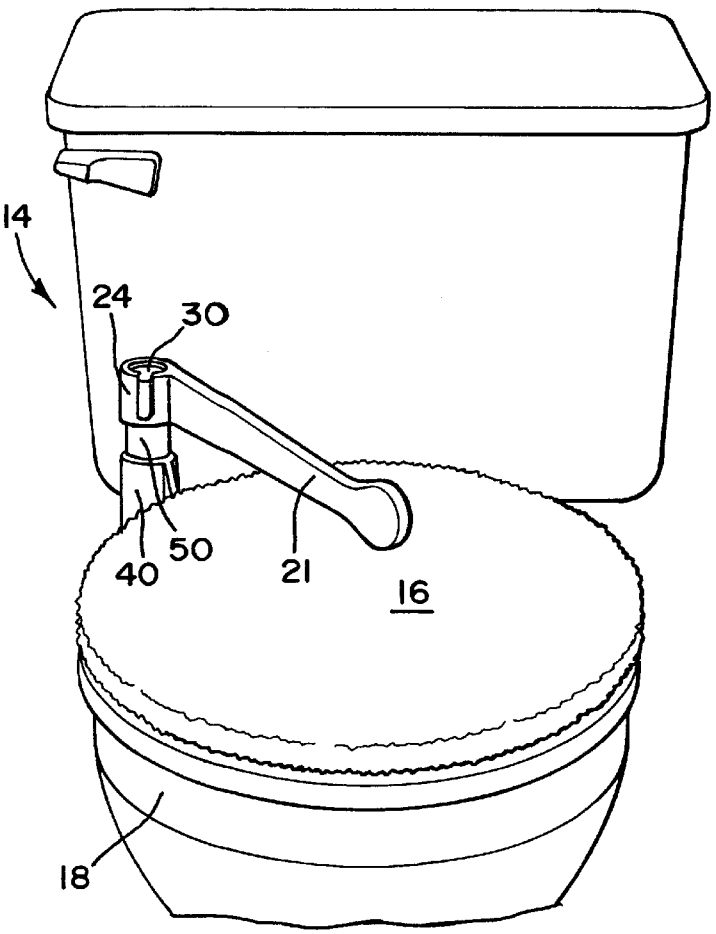
FIG. 1 is a perspective view of an embodiment of the toilet lock of the present invention assembled and attached to a toilet with its arm in the locked position.

An embodiment of the toilet lid lock of the present invention, indicated in general at 14, installed upon a toilet, indicated in general at 12, is shown in FIG. 1. The toilet lid lock features an arm 21 that is positioned across the lid of the toilet so that it will not freely open thereby keeping children and their toys out of the toilet bowl 18. The arm 21 is pivotally mounted to a lid lock base 40 and stem 50 via housing 24. A user releases arm 21 by pressing button 30 so that the arm may be pivoted to an unlocked position to permit the lid 16 to be raised as illustrated in FIG. 2.

Figure 3:
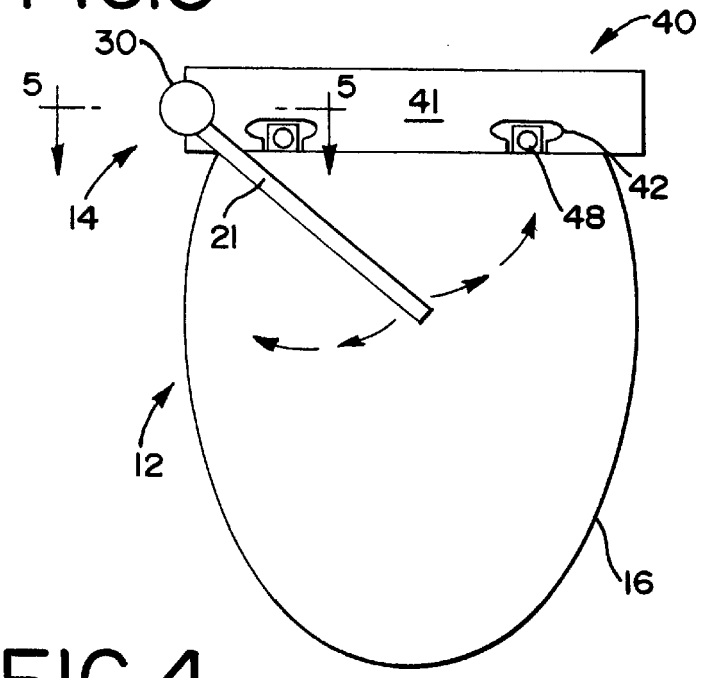
FIG. 3 is a top plan view of the locked toilet lid lock and toilet of FIG. 1.

FIG. 3 illustrates a top view of the toilet lid lock 14 and toilet 12 of FIG. 1. The toilet lid lock 14 is installed by removing the bolts 48 and the toilet seat and lid assembly 16. The flange portion 41 of base 40 is then positioned on the toilet so that the open slots 42 are positioned over the bolt holes. Next, the hinge portion of the seat and lid assembly 16 is placed on top of the base 40. The bolts 48 are then inserted and tighten so the base 40 and seat and lid assembly 16 are fastened to the toilet. The stem 50 is then inserted in to the base 40. Each section of the assembled toilet lid lock 14 will be described below in greater detail.

Figure 4:
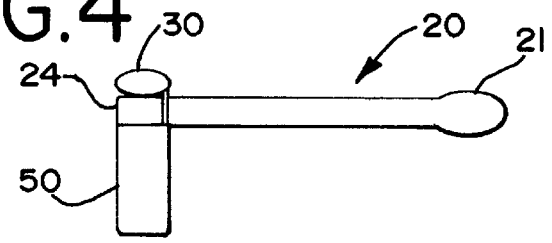
FIG. 4 is a side elevation view of the upper portion of the toilet lid lock of FIGS. 1 and 2.
Figure 5:
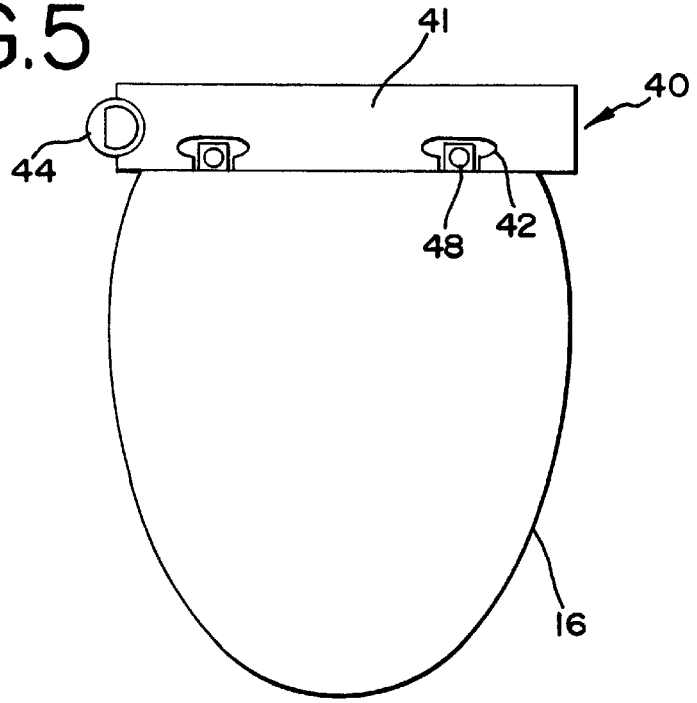
FIG. 5 is a top plan view of the base of the toilet lid lock of FIGS. 1 and 2 attached to a toilet.

FIG. 4 and FIG. 5 illustrate the sections of the toilet lid lock 14 before the lock is assembled. FIG. 4 illustrates the upper portion 20. The upper portion 20 is comprised of an arm 21 horizontally extending from a housing 24 and a release button 30 positioned in the housing 24. The housing 24 is pivotally mounted upon a vertical stem 50. FIG. 5 illustrates the base 40 of the toilet lid lock bolted to the toilet. The base 40 is positioned in the back of the toilet so it is out of the user's way. The base 40 includes a sleeve 44, which receives the stem 50 of the upper portion 20 when the toilet lid lock is assembled, and a flange portion 41 which, as described previously, is bolted to the toilet via slots 42.

Figure 6:
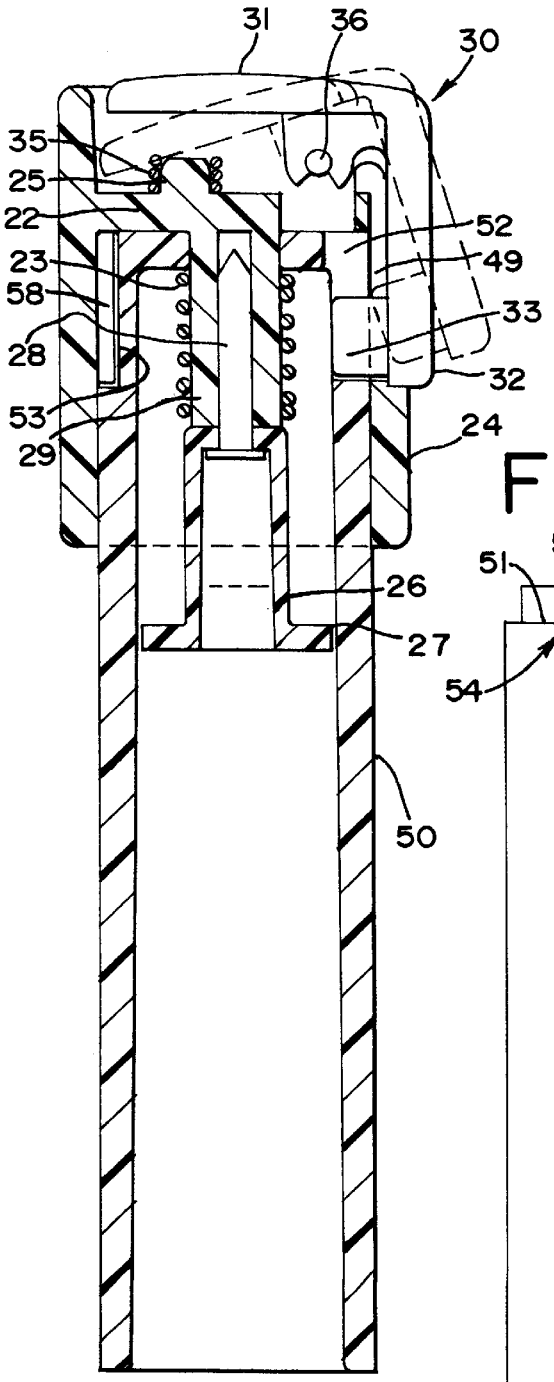
FIG. 6 is a sectional view of the stem connected to the housing of the arm taken along line 5—5 of FIG. 1 with the release button shown in the locked position and unlocked position in phantom.

FIG. 6 illustrates a sectional view of the pivotal connection of the stem 50 to housing 24. The housing 24 includes a boss 29 and a knob 25. A compression spring 35 is positioned on the knob 25. The spring 35 contacts the underside of the release button 30 for providing a spring loaded connection between the release button 30 and the housing 24.

As shown in FIG. 6, the stem 50 is inserted into the housing 24. A compression spring 23, or an elastic member, is inserted into the stem 50 and its first end is positioned over the boss 29 of the housing 24. Next a member 26 with a circular lip 27 is inserted into the second end ofthe spring 23. The member 26 is positioned so as to abut the boss 29 ofthe housing 24. A screw 28 is inserted through an opening in the member 26 and into a threaded bore formed in boss 29. As a result, the spring 23 is slightly compressed and the stem 50 is secured to the housing 24.

FIG. 6 also illustrates the release button 30. The release button includes a top 31, a vertically extending leg 32 connected to the top 31, and a tab 33 connected to the leg 32. The release button 30 is attached to the housing 24 and pivots between a locked position and an unlocked position, the latter of which is indicated in phantom. When the release button 30 is in a locked position, the tab 33 engages an aperture 52 formed in the stem 50 and maintains the housing 24 in a locked configuration so that the arm 21 (FIGS. 3 and 4) cannot be moved. When the release button is pressed into the unlocked position, the spring 35 is compressed and the tab 33 no longer engages the stem 50 as illustrated in phantom in FIG. 6. This unlocked position releases the housing 24 and the horizontally extending arm 21 and enables the user to rotate the arm 21 and unlock the toilet (as illustrated in FIG. 2).

Figure 7:
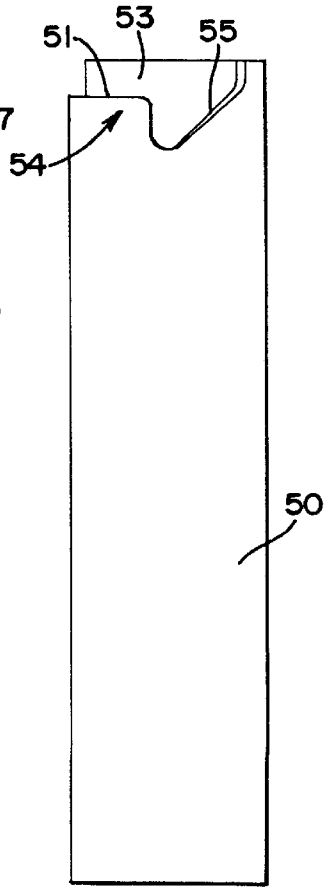
FIG. 7 is a left side elevation view of the stem of FIG. 6 illustrating the recess along the top of the stem.

FIG. 7 is a side view ofthe stem 50 with recess 53. The recess 53 is defined by a shelf 54 that includes a level portion 51 running along the top part of the stem 50 and an angled portion 55 that climbs toward the top of the stem 50. The recess 53 and shelf 54 provide guides for the housing 24 when the user rotates the arm 21 to the locked, unlocked or disarmed positions, as will be explained below.

Figure 8:
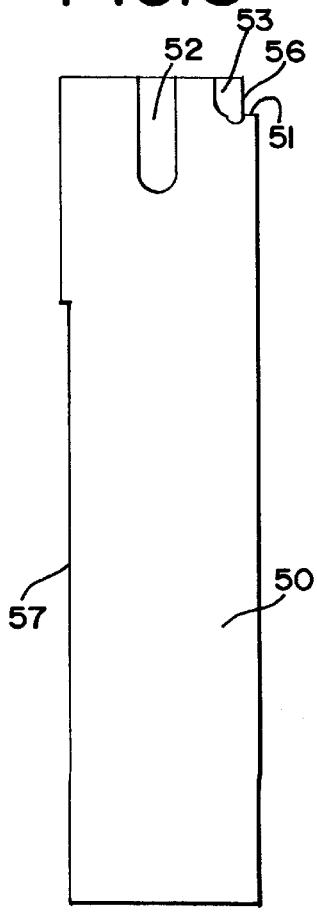
FIG. 8 is a side elevation view of the opposite side ofthe stem shown in FIG. 7 and a right side elevation view of the stem of FIG. 6, showing the aperture that receives the release button tab and the notch at the end of the recess of FIG. 7.

FIG. 8 shows the opposite side of the stem 50 with an aperture 52 for receiving the tab 33 of release button 30 (FIG. 6). The flat portion 57 of the stem 50 is also illustrated. The flat portion of the stem 57 aligns with the flat portion 46 of the sleeve 44 (shown in FIG. 11) to prevent rotation of stem 50 relative to the base 40. FIG. 8 also illustrates a notch 56 located at the end of the level portion 51 of shelf 54 (FIG. 7) that guides the housing 24 as it pivots on the stem 50.

Figure 9:
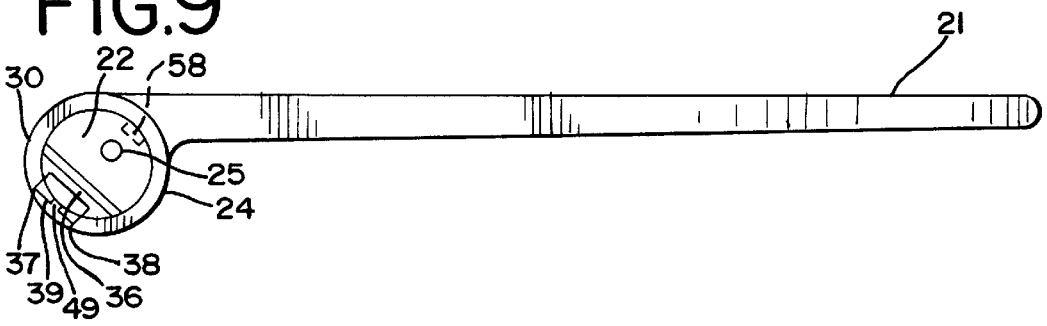
FIG. 9 is atop plan view of the arm and housing ofthe toilet lid lock of FIG. 1 and FIG. 2 with the released button removed.

FIG. 9 illustrates a top view of the arm 21 and the housing 24. The housing 24 includes a planar portion 22 (see also FIG. 6) upon which a knob 25 is formed and a cross member 36 upon which the release button 30 is clipped when assembled in the housing 24 (see also FIG. 6). The housing 24 also includes an indentation defined by left wall 37, right wall 38 and opposing walls 39 for receiving the vertical leg 32 of the release button 30. Opposing walls 39 define slit 49 through which the tab 33 passes as illustrated in FIG. 6.

Figure 10:
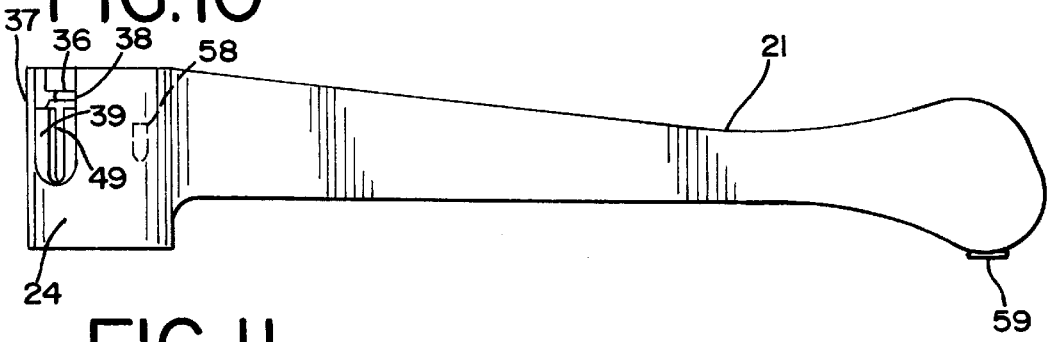
FIG. 10 is side elevation view of the arm and housing of FIG. 9.

FIG. 10 illustrates a side view of the arm 21 and the housing 24 before the release button 30 is attached. As described previously, the housing 24 includes a left wall 37, a right wall 38, and opposing walls 39 for defining slit 49. Additionally, as illustrated in FIG. 10, the arm may include a rubber stop 59 located on the bottom of the distal end of arm 21. The rubber stop 59 protects the toilet lid when the arm 21 is positioned in the locked position.

FIGS. 9 and 10 also illustrate protrusion 58, located on the underside of the housing, in phantom. When the stem 50 is inserted into the housing 24, protrusion 58 is positioned in recess 53 at the bottom of the angled portion 55 and next to the level portion 51 (see FIG. 6). When the user presses button 30, the housing 24 is released and the toilet lid lock may be rotated to the unlocked position. As the user rotates the arm 21 and housing 24, spring 29 is compressed and protrusion 58 travels up the angled portion 55 until it reaches the top of the stem 50 (FIG. 7). The toilet lid lock 14 is now in an unlocked position as illustrated in FIG. 2.

Figure 11:
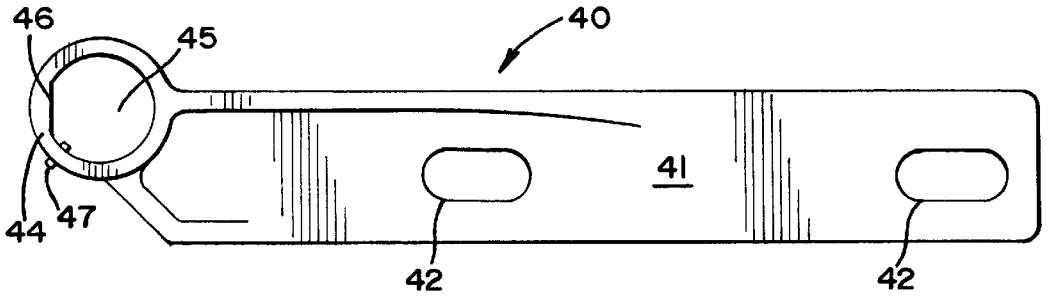
FIG. 11 is a top plan view of the base of the toilet lid lock of FIGS. 1 and 2.
Figure 12:
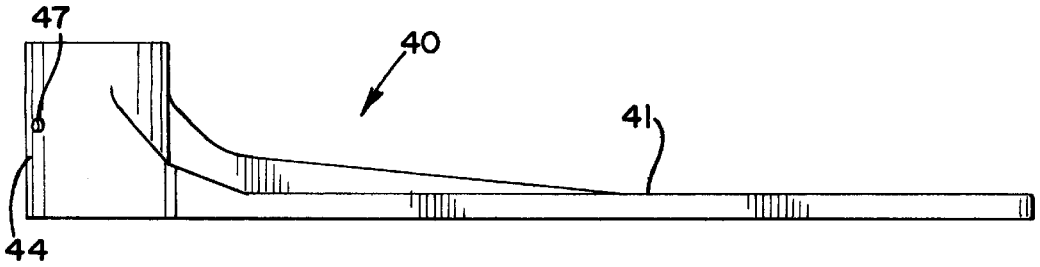
FIG. 12 is a side elevation view of the base of FIG. 11.

FIG. 11 illustrates a top view of the base 40 of the toilet Lid lock. The base 40 includes a sleeve 44 with a generally circular 45 passage that includes a flat portion 46. The stem 50 includes a flat portion 57 (see FIG. 8) that matches the flat portion 46 of the sleeve 44 so that the stem 50 may slide into the sleeve 44. The base 40 also includes a flange portion 41 with slots 42 which, as described previously, are positioned over the bolt holes on the toilet to receive the bolts that secure the base to the toilet. The sleeve 44 includes a set screw 47 that secures the stem 50 in place once the desired height between the arm and the top of the toilet lid is reached. FIG. 12 illustrates a side view of the base 40 and sleeve 44 with the set screw 47.

The toilet lid lock 14 of the present invention is constructed from a variety of durable and generally rigid plastics. The toilet lid lock is durable and easy to clean. The toilet lid lock 14 may be used with any type of cover used on the toilet lid because the height is easily adjusted by the set screw 47 in the sleeve 44. Ideally, when installing the toilet lid lock 14, the arm 21 should be positioned so it is about ⅛ of an inch above the toilet lid 16.

The toilet lid lock 14 is unlocked when the user pushes the release button 30 and rotates the arm 21 counter clockwise, as illustrated in FIG. 2. Once the arm 21 is rotated to a position parallel with the tank, the user may then lift the toilet lid to an upright position while holding the arm 21 in its unlocked position. When the toilet lid 16 is lowered, the toilet lid lock 14, due to bias of spring 29, automatically resets by returning to its original locked position so that the arm 21 extends across the toilet lid 16.

Additionally, the toilet lid lock 14 may be disarmed. To disarm the toilet lid lock 14, the user presses button 30 and then lifts the housing 24 thereby compressing the spring 23 and raising the protrusion 58 to the height of the level portion 51 of shelf 54 (FIG. 7). As arm 21 is rotated clockwise, the protrusion 58 travels along the level portion 51 until it reaches notch 56 (FIG. 8) and the arm 21 is no longer over the toilet. When the toilet lid lock 14 is disarmed, the user can freely move the toilet lid 16 from an upright position to a horizontal position.

While the preferred embodiment of the invention has been shown and described, it will be apparent to those skilled in the art that changes and modifications may be made therein without departing from the spirit of the invention, the scope of which is defined by the appended claims.

What is claimed is:

1. A toilet lid safety lock for maintaining a toilet lid of a toilet in a generally horizontal position until the lock is released, said lock comprising:

a) a base adapted to be mounted to a toilet;

b) a stem attached to the base at one side of the toilet and extending in a generally vertical direction;

c) an arm mounted to said stem and extending outwardly therefrom in a generally horizontal plane, said arm movable in said generally horizontal plane between a locked position disposed immediately above and extending diagonally across the toilet lid and an unlocked position disposed away from the toilet lid; and d) means for automatically returning said arm to the locked position from the on locked position when the toilet lid is lowered to its horizontal position.

2. The toilet lid lock of claim 1, wherein said base includes a flange with slots adapted to receive fasteners to connect said base to the toilet.

3. The toilet lid lock of claim 2, wherein said base includes a sleeve adapted to receive said stem.

4. The toilet lid lock of claim 3, wherein said sleeve includes a set screw adapted to adjust the height of the stem and, in turn, the height of said arm above the toilet seat lid.

5. The toilet lid lock of claim 1, wherein said arm includes a housing secured to said stem.

6. The toilet lid lock of claim 1, further including means for releasing said arm from the locked position to permit movement to said unlocked position.

7. The toilet lid lock of claim 6, wherein said means for releasing said arm includes a spring button adapted to be pivoted from a locked position to an unlocked position, said button including a top, a vertical leg and a tab connected to said leg for engaging said stem when said button is in the locked position.

8. A toilet lid safety lock for maintaining a toilet lid of a toilet in a generally horizontal position until the lock is released, said lock comprising:

a) a base adapted to be mounted to a toilet;

b) a stem attached to the base and extending in a generally vertical direction;

c) an arm mounted to said stem and extending outwardly therefrom in a generally horizontal plane, said arm movable between a locked position disposed immediately above the toilet lid and an unlocked position disposed away from the toilet lid;

d) means for biasing said arm to the locked position; and e) means for releasing said arm from the locked position to permit movement to said unlocked position, wherein said means for releasing said arm includes a spring button adapted to be pivoted from a locked position to an unlocked position, said button including a top, a vertical leg and a tab connected to said leg for engaging said stern when said button is in the locked position.

* * * * *